US007278421B2

(12) United States Patent
Hannah et al.

(10) Patent No.: US 7,278,421 B2
(45) Date of Patent: Oct. 9, 2007

(54) FULL FACE FLEXIBLE OXYGEN MASK FOR USE WITH FLIGHT HELMETS

(75) Inventors: Gary R. Hannah, Shawnee, KS (US); Kirsten S. Frogley, Shawnee, KS (US); Thomas K. McDonald, Overland Park, KS (US)

(73) Assignee: BE Intellectual Property, Inc., Wellington, FL (US)

( * ) Notice: Subject to any disclaimer, the term of this patent is extended or adjusted under 35 U.S.C. 154(b) by 9 days.

(21) Appl. No.: 10/495,009

(22) PCT Filed: Sep. 24, 2003

(86) PCT No.: PCT/US03/30606

§ 371 (c)(1),
(2), (4) Date: May 10, 2004

(87) PCT Pub. No.: WO2004/030766

PCT Pub. Date: Apr. 15, 2004

(65) Prior Publication Data

US 2004/0244801 A1 Dec. 9, 2004

Related U.S. Application Data

(60) Provisional application No. 60/414,901, filed on Sep. 30, 2002.

(51) Int. Cl.

| | |
|---|---|
| ***A62B 17/00*** | (2006.01) |
| ***A62B 17/02*** | (2006.01) |
| ***A62B 18/08*** | (2006.01) |
| ***A42B 3/00*** | (2006.01) |

(52) U.S. Cl. ..... 128/201.29; 128/202.11; 128/201.22; 128/201.12; 2/6.1

(58) Field of Classification Search ..... 128/201.12, 128/201.14, 201.15, 201.22, 201.23, 201.24, 128/201.27, 205.25, 206.12, 206.23, 206.24, 128/206.26, 206.27, 206.28, 207.11, 206.21, 128/201.17, 201.25, 201.19, 201.28, 201.29, 128/202.11, 202.19, 207.13, 207.14; 2/4.1, 2/4.2, 4.3, 4.7, 15, 426, 424, 447, 450, 459, 2/5, 6.1–6.3, 6.6, 6.7, 427

See application file for complete search history.

(56) References Cited

U.S. PATENT DOCUMENTS

| | | | | |
|---|---|---|---|---|
| 2,344,718 | A * | 3/1944 | Morehouse | 128/201.23 |
| 2,379,493 | A * | 7/1945 | Morehouse | 128/201.23 |
| 2,810,022 | A * | 10/1957 | Finken et al. | 381/376 |

(Continued)

FOREIGN PATENT DOCUMENTS

| | | | | |
|---|---|---|---|---|
| GB | 1191793 | * | 5/1970 | 128/205.25 |

*Primary Examiner*—Teena Mitchell
(74) *Attorney, Agent, or Firm*—Fulwider Patton LLP

(57) ABSTRACT

The full face flexible oxygen mask for use with flight helmets includes an elastic face seal with an oronasal cone that seals around the nose and mouth of the wearer, and flexible sealing flaps along the perimeter of the face seal to adapt the face piece of the mask to seal against the surface of a flight helmet. The mask face piece has two large sealing surfaces or channels down each side of the mask that overlap and flex to adapt to seal to a variety of flight helmets. The top of the face seal has an inner and outer flap that work together to seal the exposed face visible between the sides of the flight helmet.

9 Claims, 2 Drawing Sheets

U.S. PATENT DOCUMENTS 2,908,272 A * 10/1959 Motsinger ..... 128/201.15
2,918,060 A * 12/1959 Lobelle ..... 128/201.24
3,513,841 A * 5/1970 Seeler ..... 128/201.23
3,833,935 A * 9/1974 Ansite et al. ..... 2/6.2
3,910,269 A * 10/1975 Ansite et al. ..... 128/201.24
4,352,353 A * 10/1982 Bolton et al. ..... 128/201.24
4,595,003 A * 6/1986 Shoemaker et al. ... 128/201.19
D304,384 S * 10/1989 Derobert ..... D24/110.2
4,875,477 A * 10/1989 Waschke et al. ..... 128/206.21
5,039,035 A * 8/1991 Fitzpatrick ..... 244/122 AG
5,488,948 A * 2/1996 Dubruille et al. ..... 128/207.11
5,555,569 A * 9/1996 Lane ..... 2/424
5,575,278 A * 11/1996 Bonhomme et al. ... 128/201.29
D378,610 S * 3/1997 Reischel et al. ..... D24/110.2
5,630,412 A * 5/1997 Dubruille et al. ..... 128/206.23
5,653,225 A * 8/1997 Schegerin ..... 128/201.24
5,664,566 A * 9/1997 McDonald et al. .... 128/205.25
5,704,073 A * 1/1998 Sword et al. ..... 2/427
6,155,253 A * 12/2000 Gamberini ..... 128/201.18
6,401,716 B1 * 6/2002 Sword et al. ..... 128/206.21
6,520,177 B1 * 2/2003 Bonhomme et al. ... 128/201.28
6,567,220 B2 * 5/2003 McDonald et al. ..... 359/630
7,210,477 B2 * 5/2007 Templeton et al. .... 128/201.22
2002/0134381 A1 * 9/2002 Bonhomme et al. ... 128/201.24
2005/0103335 A1 * 5/2005 Fabin ..... 128/201.25

* cited by examiner

FIG. 1
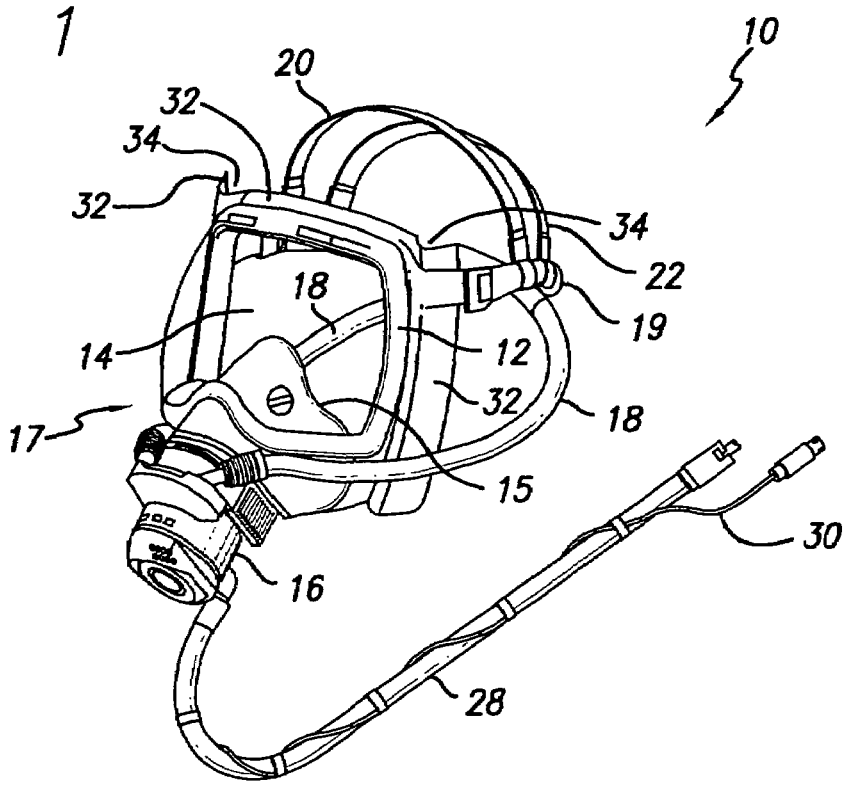
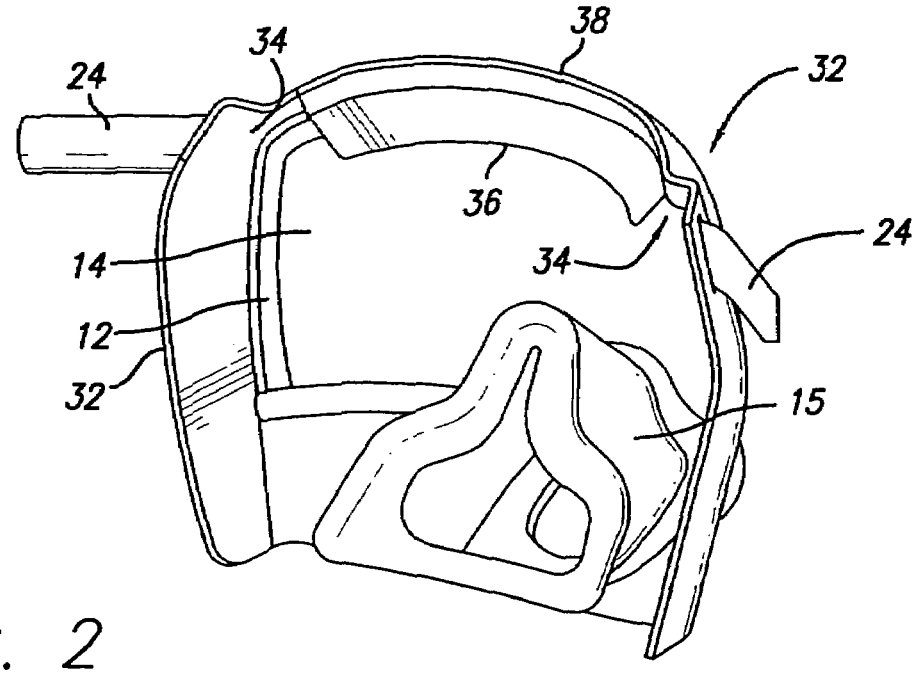
FIG. 2

FIG. 3
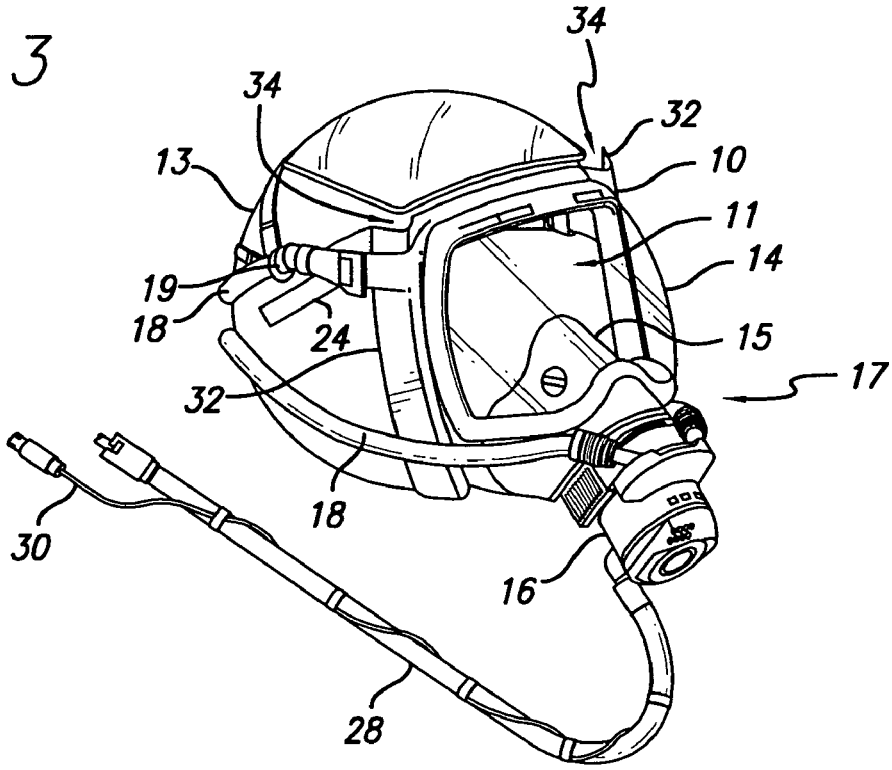
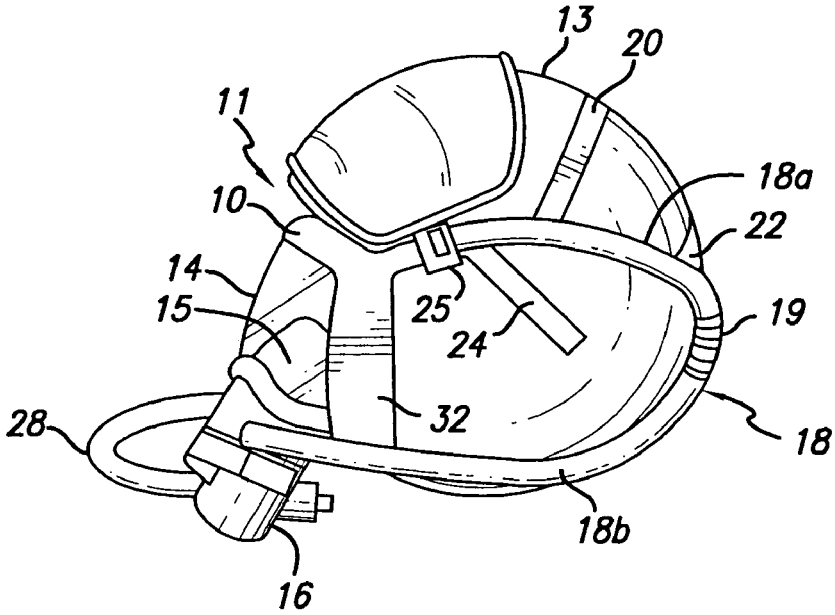
FIG. 4

FULL FACE FLEXIBLE OXYGEN MASK FOR USE WITH FLIGHT HELMETS

RELATED APPLICATIONS

This application is a U.S. national phase of PCT/US03/30606, filed 24 Sep. 2003, which is based on provisional application Ser. No. 60/414,901, filed Sep. 30, 2002.

BACKGROUND OF THE INVENTION

The present invention relates to oxygen masks, and more particularly relates to oxygen masks used with military aircraft pilot helmets.

Currently standard flight helmets for fixed wing and rotor aircraft use the same clip on oxygen mask as found on fighter helmet applications. This provides oxygen/hypoxia protection but no "smoke" protection. Smoke protection is usually considered to include some form of sealed eye protection with an integral positive pressure or other means for keeping contaminants out, in addition to respiratory protection. Flight helmets come in a variety of sizes and designs, thus making the application of a single mask to a variety of designs a difficult problem. This represents a significant disadvantage in light of the large number of different flight helmet designs that currently exist.

For example, one such conventional smoke mask that currently will fit within and interact with a flight helmet has a design that requires that the flight helmet and front opening of the flight helmet be large enough to allow the face seal of the smoke mask to fit inside the flight helmet for direct contact with the wearer's face. This design is constrained to fit completely within the flight helmet to contact the face, limiting the field of view available to the wearer.

Current full face oxygen masks are also typically designed to fit on the heads and facial features of about 5 to 95 percent of pilots and crew, but these masks typically will not fit or interact with a pilot or crew member additionally wearing a flight helmet for protection.

Thus, there is a need for an oxygen mask which provides an adequate breathing gas environment and protection from smoke and debris which can be adapted for use with a wide variety of pilot helmets. The present invention fills these and other needs.

SUMMARY OF THE INVENTION

Briefly, and in general terms, the present invention provides for a full face flexible oxygen mask for use with flight helmets, wherein the mask includes an elastic face seal that has an oronasal cone that seals around the nose and mouth to provide the maximum required contaminant and leakage protection, and flexible sealing flaps along the perimeter of the face seal to seal against the surface of a flight helmet, rather than sealing to the face of the wearer. The mask face piece has two large sealing surfaces or channels down each side of the mask that overlap and flex as necessary to adapt to seal to a variety of flight helmet designs and exterior surfaces currently being used. The top of the face seal has inner and outer sealing flaps that work together to seal the exposed face of the wearer visible between the sides of the flight helmet. In one variant, the sealing flaps may have a chamber inside that may be at least partially inflated to enhance the sealing properties of the sealing flaps. By eliminating the constraint of fitting completely within the flight helmet perimeter to contact the face of the wearer, and providing flexible sealing flaps to adapt to seal with a variety of sizes and types of flight helmets, allowing the use of larger size flight helmets, the full face flexible oxygen mask of the invention avoids limitations upon the field of view available to the wearer that are characteristic of face masks that are constrained to fit completely within the flight helmet perimeter to insure sealing contact with the face of the wearer.

These and other aspects and advantages of the invention will become apparent from the following detailed description and the accompanying drawings, which illustrate by way of example the features of the invention.

BRIEF DESCRIPTION OF THE DRAWINGS

FIG. 1 is a front perspective view of the full face flexible oxygen mask according to the invention.

FIG. 2 is an interior view of a front portion of the full face flexible oxygen mask of FIG. 1.

FIG. 3 is a front perspective view of the full face flexible oxygen mask of FIG. 1 fitted to a flight helmet.

FIG. 4 is a side view of the full face flexible oxygen mask of FIG. 1 placed fitted to a flight helmet.

DETAILED DESCRIPTION OF THE PREFERRED EMBODIMENTS

As is illustrated in the drawings, the invention is embodied in a full face flexible oxygen mask for use as a smoke mask with flight helmets, that can adapt to fit to most or all flight helmets and provide smoke/eye protection along with oxygen. The full face flexible oxygen mask is embodied in a flexible, full face coverage mask for use by aircraft flight crews in which a flexible lens is sealingly molded into the face seal, or is formed with the face seal as a single unit. The mask incorporates an inflatable harness which is inflated by the breathing oxygen regulated by a regulator incorporated into the face mask. In one aspect of the full face flexible oxygen mask, the inflatable harness is dimensioned so as to fit over the circumference of the helmet. The mask also provides for purging of the interior of the flexible lens by gas from the regulator in order to retard fogging and other obscuration of the view out of the lens by the wearer. The entire assembly is capable of being rolled up into a relatively small package, which facilitates its installation within the limited available space readily at hand to the seated crew member on the flight deck. An interactive full face mask according to the invention, stowed in a ready position for quick donning, could readily be mounted on Air Force, Naval, Army, Coast Guard type support craft such as the E-2C, C-2, P-3, and C130, for example.

Referring to FIGS. 1 and 2, the full face flexible oxygen mask 10 for use as a smoke mask with a flight helmet includes an elastic, flexible face seal or face piece 12, having a flexible lens 14 in the face seal. Referring to FIGS. 3 and 4, the full face flexible oxygen mask is formed to fit over the front opening 11 of a helmet 13. The lens of the face seal is typically made of a flexible elastomer and helps the face seal adapt to the various helmet and facial surfaces it will encounter rather than restrict it like a hard lens design would. At the same time, the flexible lens material has a high level of optical quality suitable for flying an aircraft. The elastic face seal includes an oronasal cone 15 that seals around the nose and mouth of the wearer to provide the maximum required contaminant and leakage protection.

The lower forward portion of the face seal includes an oxygen supply regulator 16 removably attached to the lower forward portion 17 of the mask to provide oxygen in diluted, 100%, positively pressurized forms to the user. The regulator supplies breathing oxygen to the wearer through ports internal to the lower forward portion of the face seal, and also supplies oxygen or other breathing gas mixtures to an inflatable harness 18 such as inflatable tubes 18*a* and 18*b*, designed to encircle the helmet, and connected to the breathing gas regulator and the face seal via suitable gas passages and connectors in the mask. As is illustrated in FIG. 4, the inflatable tubes 18*a* and 18*b* are typically joined by a connector 19. Purge valves are integral to the mask and provide a positive oxygen flow to purge any contaminants that might leak into the mask visor area, to augment the seal performance. The inflatable harness is connected to the face seal and regulator that will allow the mask to be quickly donned and positioned over a helmet. The harness, when inflated, will pull the face seal firmly against the helmet and face. Connecting straps 20 and 22 are then similarly connected at their extremities to the inflatable harness, and may also be adjustable to allow for adjustment of the size and comfort of the mask once the inflatable harness is inflated. Additional straps 24 connected to the face seal may be provided to connect the face seal to the inflatable harness, such as by an adjustable buckle 25, for example.

The use of the flexible lens in concert with the elastomeric face seal of the invention serves to improve the ability of the mask to seal out toxic or vision impairing gases. These improved face sealing characteristics also improve the oxygen consumption performance of the mask, as there is less leakage over a wider variety of face configurations. The oxygen supply for the mask is provided by an oxygen supply tube 28 connected to regulator. In order to facilitate communication, the mask may also incorporate a microphone (not shown) which can be connected to the aircraft communication system by electrical wiring 30, which may be concurrently routed with the oxygen supply tube.

Referring to FIGS. 1 and 2, flexible sealing flaps 32 are provided at selected points along the perimeter of the face seal to adapt the face seal of the mask to seal against the helmet rather than sealing to the face of the wearer. Typically the flexible sealing flaps are provided along the top, left and right sides of the face seal. The mask face piece also has two large sealing surfaces or channels 34 along each side of the mask that overlap and flex as necessary to adapt to a variety of helmet designs and exterior surfaces currently being used. As is illustrated in FIG. 2, the top sealing flap 32 of the face seal includes an inner flap 36, adapted to form a seal along the forehead of the wearer, and an outer flap 38 for sealing along the helmet, that work together to seal the exposed face visible between the sides of the helmet. In one variant, the inner and/or outer flaps of the top flexible sealing flap, as well as the left and right side flexible sealing flaps, may include one or more internal chambers that may be connected to the oxygen supply regulator so as to be at least partially inflatable to enhance the sealing properties of the sealing flaps.

The mask fits to a variety of helmet designs with slightly different dimensions and fits on the user's head. The flexibility of the frame and lens allow the mask to adapt or conform the helmet surfaces until the oronasal cone and face seal contact the recessed user's facial features. It will be appreciated that by eliminating the constraint of fitting completely within the helmet to contact the face of the wearer, the full face flexible oxygen mask of the invention avoids the limitations of field of view that are characteristic of face masks that are constrained to fit completely within the flight helmet perimeter to insure sealing contact with the face of the wearer.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A quick-donning full face oxygen mask for use as a smoke mask with a flight helmet having a forwardly facing front opening in oxygen depleted environments and environments contaminated by smoke or other pollutants comprising:

a flexible helmet seal, said flexible helmet seal including first and second sides, a top side and a bottom side, an interior, and a pliable, flexible periphery, said flexible helmet seal including a flexible optical lens in a region adapted to overlie a wearer's eyes, and the flexible helmet seal including first and second rearwardly facing side channels defined by sealing surfaces along each of said first and second sides of the mask, respectively, that overlap and fit over the forwardly facing front opening of the flight helmet and flex to adapt to seal to a variety of flight helmet designs;

first and second side flexible sealing flaps along the first and second sides of the helmet seal;

an inner top flap and an outer top flap on the top side of the flexible helmet seal, said inner and outer top flaps cooperating to seal the wearer's face between the first and second sides of the flight helmet;

an oronasal cone along the bottom side of the helmet seal that seals around the wearer's nose and mouth;

an oxygen supply regulator removably attached to said flexible helmet seal; and an inflatable harness attached to said flexible helmet seal adapted to fit over the flight helmet, said inflatable harness including at least one tube connected to said oxygen supply regulator and supplied oxygen by said oxygen regulator for inflation of said inflatable harness.

2. The mask of claim 1, wherein said inflatable harness further comprises adjustable straps connected to said flexible helmet seal at positions which allow the adjustment of the inflatable harness for size and comfort by a wearer.

3. The mask of claim 2, wherein said inflatable harness further comprises a plurality of inflatable harness tubes connected to said oxygen supply regulator and adjustably connected to said flexible helmet seal by said adjustable straps.

4. A quick-donning full face oxygen mask for use as a smoke mask with a flight helmet having a forwardly facing front opening in oxygen depleted environments and environments contaminated by smoke or other pollutants comprising:

a flexible helmet seal, said flexible helmet seal including first and second sides, a top side and a bottom side, an interior, and a pliable, flexible periphery, said flexible helmet seal including a flexible optical lens in a region adapted to overlie the eyes of a wearer, the flexible helmet seal including an oronasal cone that seals around the nose and mouth of the wearer, and the flexible helmet seal including first and second rearwardly facing side channels defined by sealing surfaces along each of said first and second sides of the mask, respectively, that overlap and fit over the forwardly facing front opening of the flight helmet and flex to adapt to seal to a variety of flight helmet designs;

first and second side flexible sealing flaps along the first and second sides of the helmet seal, an inner top flap and an outer top flap on the top side of the flexible helmet seal, said inner and outer top flaps cooperating to seal the wearer's face between the first and second sides of the flight helmet;

an oxygen supply regulator removably attached to said flexible helmet seal; and an inflatable harness attached to said flexible helmet seal adapted to fit over the flight helmet, said inflatable harness including at least one tube connected to said oxygen supply regulator and supplied oxygen by said oxygen regulator for inflation of said inflatable harness.

5. The mask of claim 4, wherein said inflatable harness further comprises adjustable straps connected to said flexible helmet seal at positions which allow the adjustment of the inflatable harness for size and comfort by a wearer.

6. The mask of claim 4, wherein said inflatable harness further comprises a plurality of inflatable harness tubes connected to said oxygen supply regulator and adjustably connected to said flexible helmet seal by said adjustable straps.

7. A quick-donning full face oxygen mask for use as a smoke mask with a flight helmet having a forwardly facing front opening in oxygen depleted environments and environments contaminated by smoke or other pollutants comprising:

a flight helmet seal, said flight helmet seal including first and second sides, a top side and a bottom side, an interior, and a pliable, flexible periphery, said flight helmet seal including a flexible optical lens in a region adapted to overlie the eyes of a wearer, the flight helmet seal including an oronasal cone that seals around the nose and mouth of the wearer, and the flight helmet seal including first and second rearwardly facing side channels defined by sealing surfaces along each of said first and second sides of the mask, respectively, that overlap and fit over the forwardly facing front opening of the flight helmet and flex to adapt to seal to a variety of flight helmet designs;

an inner top flap and an outer top flap disposed on the top side of the flight helmet seal, said inner and outer top flaps cooperating to seal the wearer's face between the first and second sides of the flight helmet;

an oxygen supply regulator removably attached to said flight helmet seal; and an inflatable harness attached to said flight helmet seal adapted to fit over the flight helmet, said inflatable harness including at least one tube connected to said oxygen supply regulator and supplied oxygen by said oxygen regulator for inflation of said inflatable harness.

8. The mask of claim 7, wherein said inflatable harness further comprises adjustable straps connected to said flight helmet seal at positions which allow the adjustment of the inflatable harness for size and comfort by a wearer.

9. The mask of claim 7, wherein said inflatable harness further comprises a plurality of inflatable harness tubes connected to said oxygen supply regulator and adjustably connected to said flight helmet seal by said adjustable straps.

* * * * *